US006708429B1

(12) United States Patent
Vilou

(10) Patent No.: US 6,708,429 B1
(45) Date of Patent: Mar. 23, 2004

(54) METHOD AND DEVICE FOR POWERING A MOTOR VEHICLE ELECTRIC STARTING SWITCH WITH DETERMINABLE BEHAVIOR

(75) Inventor: Gérard Vilou, Tassin la Demi Lune (FR)

(73) Assignee: Valeo Equipements Electriques Moteur, Creteil (FR)

( * ) Notice: Subject to any disclaimer, the term of this patent is extended or adjusted under 35 U.S.C. 154(b) by 365 days.

(21) Appl. No.: 09/914,396

(22) PCT Filed: Dec. 18, 2000

(86) PCT No.: PCT/FR00/03447

§ 371 (c)(1),
(2), (4) Date: Aug. 28, 2001

(87) PCT Pub. No.: WO01/48372

PCT Pub. Date: Jul. 5, 2001

(30) Foreign Application Priority Data

Dec. 28, 1999 (FR) ..... 99 16573

(51) Int. Cl.[7] ..... F02N 17/00
(52) U.S. Cl. ..... 37/10.6; 307/116; 123/179.1
(58) Field of Search ..... 307/116, 10.6; 123/179.1; 340/428; 701/32

(56) References Cited

U.S. PATENT DOCUMENTS

| | | | | |
|---|---|---|---|---|
| 5,351,185 A | | 9/1994 | Takeuchi et al. | 700/79 |
| 5,579,194 A | * | 11/1996 | Mackenzie et al. | 361/24 |
| 5,694,100 A | * | 12/1997 | Jacquet et al. | 335/120 |
| 5,703,551 A | * | 12/1997 | Lefebvre et al. | 335/126 |

FOREIGN PATENT DOCUMENTS

| | | |
|---|---|---|
| EP | 0751545 | 1/1997 |
| EP | 0921305 | 6/1999 |
| EP | 0921306 | 6/1999 |
| FR | 2795884 | 1/2001 |

* cited by examiner

*Primary Examiner*—Gregory J. Toatley, Jr.
(74) *Attorney, Agent, or Firm*—Liniak, Berenato & White

(57) ABSTRACT

The invention relates to a method of supplying power to a motor-vehicle electric-starter contactor (10) in which, on a circuit (T1, B, 20, 25) for supplying power to the contactor (10), an effective-power-supply signal (R1, R2, R3) is provided having a chosen profile, characterised in that, on the power-supply circuit (T1, B, 20, 25), a supplementary signal (T, R4) is also provided having a shape which is chosen in order to facilitate the identification of the profile of the effective-power-supply signal (R1, R2, R3).

11 Claims, 2 Drawing Sheets

METHOD AND DEVICE FOR POWERING A MOTOR VEHICLE ELECTRIC STARTING SWITCH WITH DETERMINABLE BEHAVIOR

BACKGROUND OF THE INVENTION

The invention relates to the methods and devices for control of motor-vehicle starters.

A motor-vehicle starter conventionally includes (FIG. 1) an electric motor M, a contactor 10, and a circuit 20 for control of this contactor 10.

The contactor 10 includes a coil B (or several) and a movable core driving a switch K. For further details, refer to document FR-A-2 795 884 filed on Jun. 28, 2000, and more particularly to FIG. 1 of it.

Hence, when the coil B is supplied with electricity, the starter switch actuated, for example, by the ignition key so much [sic] closed, the movable core is allowed to move and to act on a rod shackled elastically to a movable contact, conventionally plate-shaped and intended, at the end of travel, to come into contact with fixed, electrical power-supply terminals linked respectively to the positive terminal (+Bat) of the battery and to the electric motor M. The switch K therefore includes the movable contact and the terminals. When it is closed the motor M is supplied with power.

The control circuit 20 includes a transistor T1, placed in series with the coil B, as well as a microcontroller 25 for control of this transistor T1.

The contactor 10 therefore has a role of electrical switch between a source (the battery of the vehicle) and the motor M, and also a role as actuator for means of meshing between the motor M and the internal-combustion engine of the vehicle.

More precisely, as can be seen in FIG. 1 of the above-mentioned document FR-A-2 795 884, the contactor 10 is installed above the motor M, being parallel to it.

The movable core is shackled to the upper extremity of a fork-shaped lever with an intervening spring called tooth-on-tooth spring.

The lower end of the lever is configured to act on an inertia-type drive including a hub, a pinion and a free wheel interposed between the pinion and the hub; the said free wheel comprising an outer cage-shaped part integral with the hub, an inner part integral with the pinion and rollers interposed between the inner and outer parts.

The pinion, when it is moved by the lever via the movable core, is intended to mesh with the starter ring of the internal-combustion engine of the motor vehicle, knowing that the hub of the inertia-type drive meshes with an output shaft configured to be driven directly or indirectly by the electric motor M.

Because of this second role of the contactor, and for reasons of wear on the core, it has proved to be necessary to avoid over-rapid movement of the latter.

In order to exert control over the kinematics of movement of the movable core and of the inertia-type drive, a variation in useful current strength in the coil B is chosen, especially by taking into account various mechanical parameters specific to the inertia-type drive in question, such as its inertia and the friction forces which it encounters during its advance movement from its rest position to its working position.

Account is also taken of the inertia and of the friction forces of the core.

By way of example, the mass of an inertia-type drive may vary from 1 to 4, depending on whether it is intended for a starter of a small private vehicle or a heavy-goods-vehicle starter. Similarly, the friction of an inertia-type drive is markedly greater for a sliding-pinion starter than for an ogive-type pinion starter.

It has been proposed, in the document FR-A-2 795 884, to supply the coil of the contactor with a variable, pulsed current, the variation in the duty cycle of which, and thus in the effective current in the course of time, depend [sic] on the parameters of the movable core.

Depending on the starter for which it is intended, the microcontroller 25 is programmed appropriately.

In practice, the microcontroller 25 is placed on an electronics card, and the cards often differ only in the programming of the microcontroller. The card is preferably mounted into the contactor 10 in the vicinity of the fixed core of the contactor 10 as described, for example, in the document EP-A-0 751 545 to which reference will be made for further details. The risks are therefore higher of confusing the cards and of equipping contactors, starters or vehicles with unsuitable cards by mistake.

Moreover, this type of mistake is difficult to identify once the card has been mounted into the contactor, and the latter mounted on the starter, given that the electronic circuits associated with the contactor are integrated into it.

One solution would be to have an electronic socket for diagnosis on the contactor. However, such a socket features a bulky connector. Moreover, this amounts to an expensive solution.

BRIEF SUMMARY OF THE INVENTION

The invention proposes to overcome this drawback here, that is to say to make it possible easily and reliably to identify the type of programming of a contactor-control microcontroller, especially when it is already mounted onto the starter.

This object is achieved, according to the invention, by a method of supplying power to a motor-vehicle electric-starter contactor in which, on a circuit for supplying power to the contactor, an effective-power-supply signal is provided having a chosen profile, characterised in that, on the power-supply circuit, a supplementary signal is also provided having a shape which is chosen in order to facilitate the identification of the profile of the effective-power-supply signal.

The invention also proposes a device for supplying power to a motor-vehicle starter contactor, including a circuit for supplying power to the contactor and means for providing, on this circuit, an effective-power-supply signal having a chosen profile, characterised in that it also includes means for providing, on the power-supply circuit, a supplementary signal having a shape which is chosen in order to facilitate the identification of the chosen profile of the effective-power-supply signal.

BRIEF DESCRIPTION OF THE DRAWINGS

Other characteristics, objects and advantages of the invention will emerge better on reading the description which will follow, given by reference to the attached figures, in which.

DETAILED DESCRIPTION OF THE DRAWINGS

Figure 1:
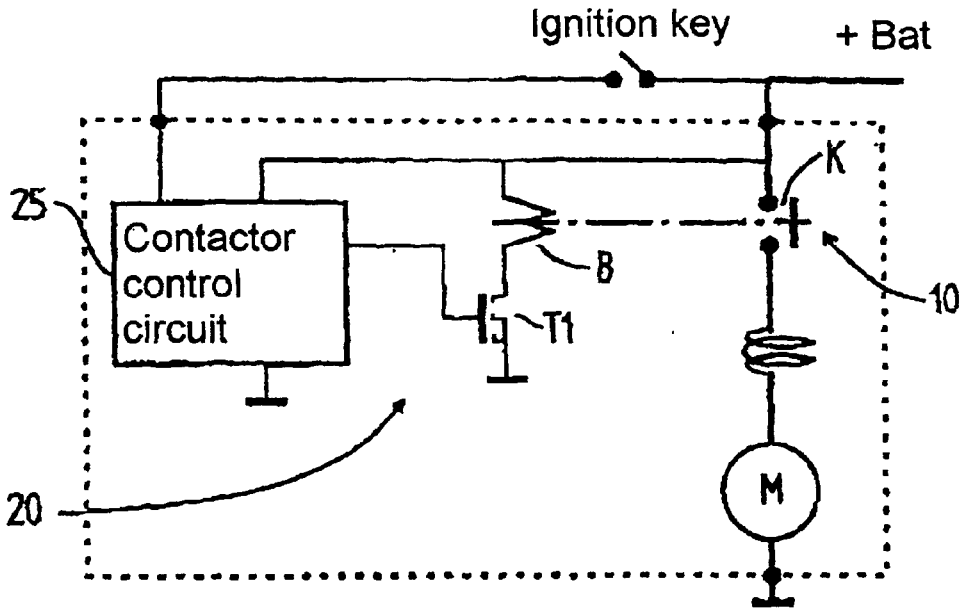
FIG. 1 represents a layout for supplying power to a starter contactor in accordance with the state of the art.
Figure 2:
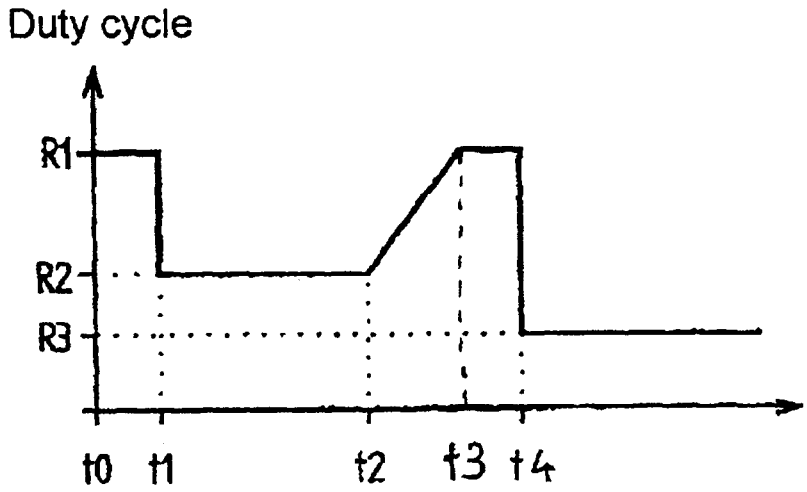
FIG. 2 is a plot representing the profile of a voltage duty cycle of power supply to a contactor coil.

In FIG. 2 has been represented, on the abscissae, successive instants in the course of the movement of a movable contactor core (core pull-in period), and on the ordinate the duty cycle of the power-supply voltage to the coil B of the contactor.

Figure 3:
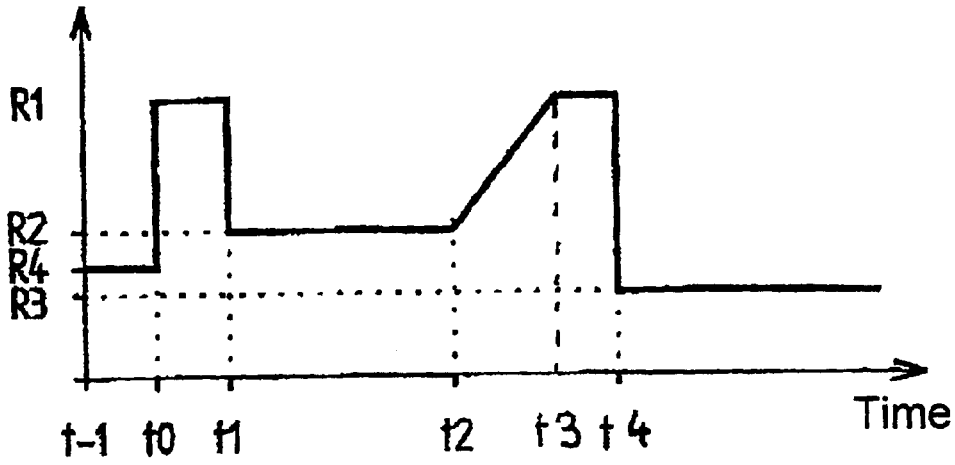
FIG. 3 is a plot representing the profile of a voltage duty cycle of power supply to a contactor coil, according to the invention.

This FIG. 2 is identical to FIG. 3 of the document FR-A-2 795 884. Thus the coil B is supplied with power by way of the transistor T with pulse-width-modulation (PWM) type pulses, according to the usual terminology, the transistor T being driven by the microcontroller 25.

During a first phase, lasting from an instant $t_0$ to an instant $t_1$, a duty cycle R1 is adopted, which is close to or equal to 100%. During this phase, a high effective current passes through the coil B and the movable core is subjected to an attraction force which is sufficient to unseat it from its rest position and to put it into motion. This phase is short enough not to produce a high attraction force on the core except for the purpose of unseating it.

During a second phase, lasting from the instant $t_1$ to an instant $t_3$, the transistor $T_1$ is first of all (up to an instant $t_2$) the seat of a duty cycle R2 substantially equal to 50%, such that the effective current in the coil B is just sufficient to overcome residual friction forces, which are reduced after the unseating of the movable core. During this first interval, the movable core therefore carries on with its movement until the contactor closes, without excessive speed.

In a second interval of this second phase, which runs from the instant t2 to the instant t3, after a time which is determined or predetermined in the accidental case in which the switch K might not have been able to be closed especially when abnormally high forces are present in the contactor, the fork, the inertia-type drive and/or the motor M—the movable contact of the switch K not being in contact with the electrical power-supply terminals—the microcontroller 25 implements a continuous and progressive increase in the duty cycle, going from the ratio R2 and returning to the ratio R1. This interval makes it possible, via the progressive increasing of the effective current strength, to ensure closure of the contactor 10.

In a further phase running from the instant t3 to an instant t4, the duty cycle is held at R1 so as to keep the movable core in its contacting position (switch K closed) with a high attraction force which prevents the movable core bouncing against the fixed core of the contactor.

This arrangement makes it possible to be able to absorb the current spikes due to the starting of the internal-combustion engine by the electric motor M. Afterwards, in a third phase, a duty cycle R3 is adopted, here lower than R2, in order to keep the switch in closure position. Needless to say, between the instants t3 and t4, a duty cycle higher than R1, for example, can be adopted.

The plot of FIG. 3 reiterates this particular shape of the profile of the duty cycle, in which the duration and duty-cycle values are matched to the specific mechanical characteristics of the associated contactor.

The plot of FIG. 3, however, according to one characteristic of the invention, exhibits a preliminary phase, lasting from an instant $t_{-1}$ to the instant $t_0$, during which the coil B receives a pulse train which is chosen so as to be both easily examined by a user, by the use of simple facilities, and at the same time easily recognisable, that is to say exhibiting specific shape characteristics which are easily recognised and render it unlikely to be confused with another signal.

This pulse train is specifically adopted here with the duty-cycle profile described above, from which it is indissociable since it is programmed into the microcontroller 25 simultaneously with this particular profile.

In the present example, this pulse train L, because it exhibits a particular shape, associated exclusively with the preceding duty-cycle profile, constitutes an intrinsic reference or a marking of this particular control signal, intrinsic to the object which it is to identify, namely the behaviour of the microcontroller 25.

There can therefore be no mistake between the indication which this preliminary signal constitutes and the control signal actually generated by the microcontroller 25.

The pulse train here features a duty cycle R4 lower than R2, such that the effective current strength resulting from this pulse train does not cause any movement of the movable core, so that there is no mechanical effect on the contactor.

Figure 4:
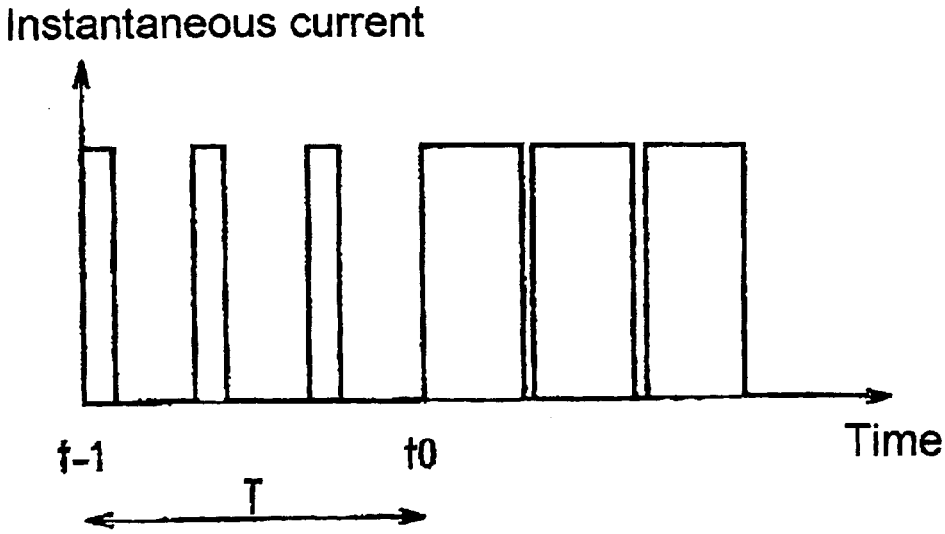
FIG. 4 represents a train of identification pulses according to the invention.

This pulse train has been represented in more detail in FIG. 4. Here, the duty cycle R4 is higher than the duty cycle R3. In a variant it is lower than the ratio R3.

The specific shape characteristics of this pulse train here lie in its total duration T (equal to the difference between to and $t_{-1}$).

In the present example, a different duration T is therefore chosen for cards having different behaviours.

Thus, the reference of a card used on an electronic starter is easily identified, via this duration T, without any additional circuitry on the starter, both on a production line and on a complete starter or even on a starter mounted on a vehicle. Moreover, this identification does not require any dismantling.

This duration T also corresponds to a predetermined number of pulses.

Using an oscilloscope, which measures the instantaneous current strength, an operator can easily identify this number of pulses which have appeared during this preliminary phase. To that end he samples the control signal, for example at the output of the microcontroller 25, at the input of the transistor T1, at the output of the transistor T1, or else the voltage at the terminals of the coil B.

Such an identification signal can also be detected by the use of a detection device configured to recognise it, for example pre-programmed to react to the expected signal.

This identification signal can, in a variant, reveal the power-supply mode, by being the seat of a coding.

Such a coded pulse train may especially exhibit a ratio of duration between the high state and the low state which is characteristic of the variation in current strength delivered by the card to the coil B upon starting.

The identification can also be done via a coded pulse train including at least two levels of duration in the high state.

The identification signal is, for example, a pulse-width-modulation (PWM) type signal. In one simple embodiment, a PWM frequency of the signal, from $t_{-1}$ to $t_0$, is programmed which is different from the frequency used after $t_0$, and the identification is done by measuring the frequency. In another embodiment, the identification signal is programmed with a frequency modulation according to a given code.

In these various cases, the pulse train on the power-supply circuit of the coil or coils of the contactor, (here prior to the operation of the contactor 10), exhibits a coding which makes it possible to identify the type of programming used in the microcontroller 25, without this pulse train putting the movable core into motion (but not restrictively).

Thus the supplementary signal can be chosen so as to have no mechanical effect on the contactor.

The pulse train reveals a specific programming, and makes it possible, for example, to distinguish between control programmings which can be very similar to one another and which would be difficult to differentiate otherwise. It makes it possible, for example, to differentiate between adaptive programmings by revealing the type of adaptation which they implement.

In a variant, the supplementary signal is not a pulse train.

Needless to say, the present invention is not limited to the embodiment example described. For example, in the second interval of the second phase, the microcontroller 25 may systematically implement a continuous and progressive increase in the duty cycle even in the event of correct operation. In a variant, this increase in the duty cycle can be carried out in a nonprogressive way via an abrupt increase in the duty cycle so as to regain the ratio R1.

Thus, in all cases, an effective-power-supply signal having a chosen profile is provided on a power-supply circuit for the contactor and, according to the invention, a supplementary signal is also provided having a shape which is chosen in order to facilitate the identification of the profile of the effective-power-supply signal.

What is claimed is:

1. Method of supplying power to a motor-vehicle electric-starter contactor (10) in which, on a circuit (T1, B, 20, 25) for supplying power to the contactor (10), an effective-power-supply signal (R1, R2, R3) is provided having a chosen profile, characterised in that, on the power-supply circuit (T1, B, 20, 25), a supplementary signal (T, R4) is also provided having a shape which is chosen in order to facilitate the identification of the profile of the effective-power-supply signal (R1, R2, R3).

2. Method according to claim 1, characterised in that the supplementary signal (T, R4) is chosen so as to have no mechanical effect on the contactor (10).

3. Method according to claim 1, characterised in that the supplementary signal (T, R4) is a pulse train.

4. Method according to claim 1, characterised in that the supplementary signal (T, R4) features a chosen duration (T) specific to the profile of the effective-power-supply signal (R1, R2, R3).

5. Method according to claim 3, characterised in that the supplementary signal (T, R4) exhibits a chosen number of pulses specific to the profile of the effective-power-supply signal (R1, R2, R3).

6. Method according to claim 3, characterised in that the pulse train (T, R4) exhibits a ratio of duration between a high state and a low state which is specific to the profile of effective current strength.

7. Method according to claim 3, characterised in that the pulse train (T, R4) constitutes a coding the high states of which exhibit at least two different durations.

8. Method according to claim 3, characterised in that the pulse train (T, R4) exhibits a frequency (R4) which is different from that used to introduce the variation in effective current strength (R1, R2).

9. Method according to claim 3, characterised in that the pulse train (T, R4) exhibits a chosen frequency modulation.

10. Method according to claim 1, characterised in that the supplementary signal (T, R4) is generated before generating the effective-power-supply signal (R1, R2, R3).

11. Device for supplying power to a motor-vehicle starter contactor (10), including a circuit (T1, B, 20, 25) for supplying power to the contactor (10) and means (25, T1) for providing, on this circuit (T1, B, 20, 25), an effective-power-supply signal (R1, R2, R3) having a chosen profile, characterised in that it also includes means (25, T1) for providing, on the power-supply circuit (T1, B, 20, 25), a supplementary signal (T, R4) having a shape which is chosen in order to facilitate the identification of the chosen profile of the effective-power-supply signal (R1, R2, R3).

* * * * *